US006287362B1

(12) United States Patent
Levey et al.

(10) Patent No.: US 6,287,362 B1
(45) Date of Patent: Sep. 11, 2001

(54) PRODUCTION OF METAL LUMPS AND APPARATUS THEREFOR

(75) Inventors: Fiona Catherine Levey, Centurion; Michael Bernard Cortie, Sandton; Ian James Barker, Randburg, all of (ZA)

(73) Assignee: Mintek, Randburg (ZA)

( * ) Notice: Subject to any disclaimer, the term of this patent is extended or adjusted under 35 U.S.C. 154(b) by 0 days.

(21) Appl. No.: 09/011,765

(22) PCT Filed: Sep. 9, 1996

(86) PCT No.: PCT/GB96/02209

§ 371 Date: Jun. 22, 1998

§ 102(e) Date: Jun. 22, 1998

(87) PCT Pub. No.: WO97/09145

PCT Pub. Date: Mar. 13, 1997

(30) Foreign Application Priority Data

Sep. 7, 1995 (ZA) ..... 95/7505

(51) Int. Cl.[7] ..... B22F 9/08

(52) U.S. Cl. ..... 75/331; 264/11; 264/266; 264/236; 264/425; 264/7

(58) Field of Search ..... 425/7; 266/236; 75/331; 264/11

(56) References Cited

U.S. PATENT DOCUMENTS

| | | | | |
|---|---|---|---|---|
| 2,252,876 | | 8/1941 | Woodford . | |
| 2,738,548 | | 3/1956 | Kassel . | |
| 3,023,454 | * | 3/1962 | Kuzell et al. | 425/7 |
| 4,152,138 | * | 5/1979 | Ripley et al. | 420/88 |

FOREIGN PATENT DOCUMENTS

| | | | | |
|---|---|---|---|---|
| 144134 | | 5/1914 | (DE) . | |
| 368570 | | 2/1923 | (DE) . | |
| 1 458 808 | | 2/1969 | (DE) . | |
| 1 484 333 | | 9/1967 | (FR) . | |
| 2 260 376 | | 9/1975 | (FR) . | |
| 64-55308 | * | 3/1989 | (JP) | 75/337 |
| 4-329805 | * | 11/1992 | (JP) | 75/337 |
| 1696149 | * | 12/1991 | (RU) | 75/337 |

* cited by examiner

*Primary Examiner*—Melvyn Andrews
(74) *Attorney, Agent, or Firm*—Jones, Tullar & Cooper, P.C.

(57) ABSTRACT

Metal lumps or pebbles are produced by introducing a molten metal stream into a stream of water in a direction which is substantially the same as the direction of the water stream and at a velocity which is substantially the same or slightly less than the velocity of the water stream.

34 Claims, 6 Drawing Sheets

FIG. 1(a)
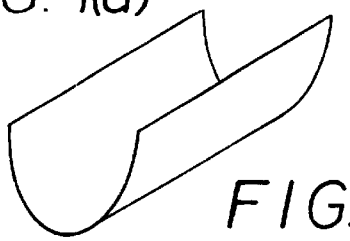
FIG. 1(b)
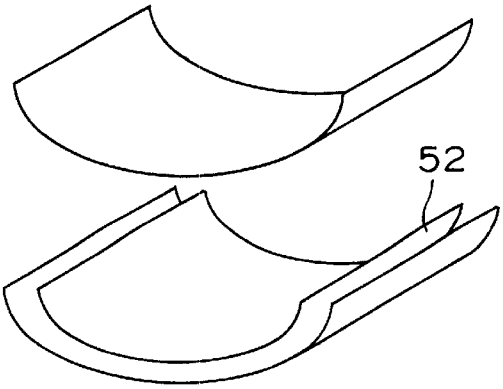
FIG. 1(c)
FIG. 1(d)
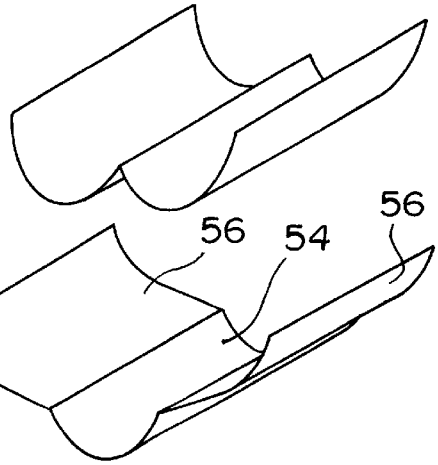
FIG. 1(e)
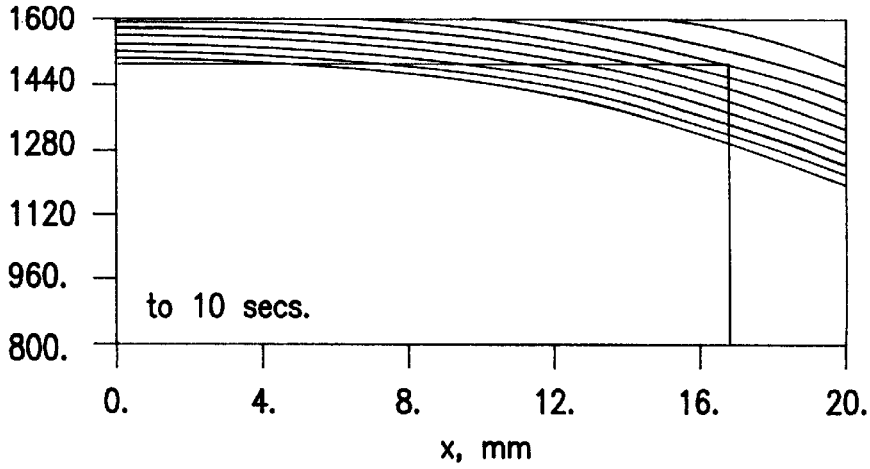
FIG. 2

PRODUCTION OF METAL LUMPS AND APPARATUS THEREFOR

FIELD OF INVENTION

This invention relates to the production of lumps of metal from the corresponding liquid of the metal, and more specifically to the casting of iron, steel, slag, ferroalloys, and other metals and their alloys into biscuit-shaped lumps where the longest dimension is typically of the order of 20 to 100 mm. These lumps are significantly larger than those produced by existing granulation methods. As used herein "metal" or "material", depending on the context, includes substantially pure metals, metallic alloys, and slags produced by or from metallic processes.

BACKGROUND OF THE INVENTION

In the metallurgical industry, there are a number of processes in which a product has to be temporarily cooled down, stored and possibly transported, and later remelted. Such a product is defined herein as a "product for remelting" (PFR).

The most common PFRs are the ferroalloys like ferro-chromium, ferro-manganese, ferro-nickel and ferro-silicon, which are used as a source of alloying elements during the manufacture of certain types of steels. The furnaces that produce these PFRs are often geographically distant from the site of their end use. There are also some other metals like aluminium, copper and zinc, and some of their alloys, that are similarly produced in a different place from where they are used. These materials therefore need to be converted from the liquid form to some type of solid form that can be handled and transported.

Another type of PFR arises and is later consumed in the same plant. This typically occurs when a downstream production unit is taken off line for maintenance, but the upstream unit continues to produce. The hot metal that continues to come from the upstream unit cannot be held molten in storage until the downstream unit comes back on line, and consequently must be converted into a solid form that can later be remelted or blended in. The PFR is then effectively a buffer between stages. An example of a plant where this could occur is an integrated iron and steel works, where a blast furnace produces pig iron that is then fed to a steel plant for conversion to steel, that goes on in turn to a continuous caster. In this case, if the steel plant stops the pig iron must be taken elsewhere, while if the continuous caster stops the steel must be handled in some other way.

Existing methods of handling PFRs are mainly the following.

Bed Casting, and Pooling

Here, the molten material is poured into moulds on the ground, and after cooling is broken up into lumps of the required size. A problem here is the unavoidable production of a certain amount of unwanted fines.

Ingot Casting, Including Casting Strands and "Chocolate Moulds"

In this process, the liquid material is poured into moulds. These may be either individual moulds, or may be assembled in a continuous loop as a casting strand. It is a relatively expensive process, tends to be labour intensive, and requires careful operation.

Granulating

In essence, this involves breaking up a stream of molten material either by means of a water jet or on a target, with the material then falling into a tank of water. The particles produced tend to be smaller than desired by end users, and the product is usually wet when it comes from the process, but the product is suitable for easy mechanical handling.

There are of course many other methods for casting hot materials, but these are of rather marginal relevance to PFRs. One such process is atomising, in which the molten material is converted to a fine powder by means of a high pressure jet of water or gas. This powdered product is too fine for remelting, and is typically used for powder metallurgical processing, for welding electrodes or as a heavy-medium for mineral separation.

Existing Types of Granulation

In one version of this process, a strong jet of water at a speed of between 5 and 15 m/s is directed to collide with a falling stream of material. This breaks up the material into droplets between about 1 and 20 mm in size which fall into a bath of water and solidify. In another implementation, a stream of molten material is broken up by a refractory target placed in its path, and the resulting droplets, varying up to about 25 mm in size, then fall into a bath of water. The former process is widely known in the industry as the Showa Denko process, and the latter as the Granshot process. Another process, which is generally used in the granulation of slag, has a near-vertical stream of molten material colliding with strong horizontal jets of water, with the mixture being swept along a near-horizontal launder filled with rapidly-flowing water. Lastly, lead shot is made by allowing droplets of molten material to fall about 45 meters through air in a device known as a shotting tower. The resulting droplets, which are usually a millimeter or two in diameter, solidify as they fall through the air.

The techniques used in the aforementioned processes have by now entered the public domain, —see for example the Granshot process patented in 1975 in U.S. Pat. No. 3,888,956. However, there are some new variations that have been patented more recently. For example, South African patent ZA 90/4005A, describes a scheme like an extension to the Granshot process, in which the refractory element on which the molten metal stream impacts is oscillated vertically. Other patents, ZA 91/2653 and U.S. Pat. No. 5,258,053 (1993), describe a process in which molten metal is run onto a refractory target shaped like a launder and then into a tank of water. The outlet of this target is close to the surface of the water, and the water within the tank is kept reasonably still, with a gentle and uniform flow of less than 0.1 m/s being directed at right angles to the submerged metal stream.

U.S. Pat. No. 4,192,673 addresses the problem of particles, of ferro-nickel in their specific case, that form flat wrinkled shapes during granulation, because of the generation of carbon monoxide (CO) gas as the ferro-alloy cools. The inventors claim that this can be prevented by the addition of deoxidising agents such as particularly aluminium, but also ferro-silicon, ferro-manganese and the like.

An example of a newer development for the granulation of slag is disclosed in U.S. Pat. No. 4,374,645. Here, the molten slag is first contacted with a high-speed jet of warmer water to break it up, after which it falls into a slower cooler stream of water.

Deficiencies of the Prior Art

The following are some of the main deficiencies.

The bed-casting and mould-casting processes require labour to be present in the vicinity of the casting operation. Molten metal, particularly in the quantities employed in iron, steel and ferro-alloy production, is exceedingly dangerous.

The exposure of hot metal to the air often generates fumes. Large pools of hot metal therefore tend to be associated with rather more pollution than is desirable.

As mentioned previously, the process of breaking up a block of cast alloy generates a portion of fines which have a lesser commercial value. The granulation process lessens the problem of fines, but the dimensions of the granules produced by the existing processes remain somewhat smaller than those that the end users consider optimum.

The granulation process can sometimes produce "corn flakes", which are light fluffy paper-like particles, instead of normal granules. These may subsequently break up into smaller particles, which then create similar problems to the fines from casting.

Existing granulation processes are susceptible to occasional explosions, often associated with an accumulation of a large mass of hot metal under the water.

Granulated material is normally wet when it comes from the granulator. This wetness can give problems when the material is used subsequently and such material must usually be dried.

Identification of the Need

Most users would seem to prefer lumps of ferro-alloy in about the 20 to 100 mm size range. This is said to be because lumps of that size range will fall rapidly through the slag layers covering a typical bath of molten metal. It is also a requirement that the material should feed easily through the existing materials handing systems. The material should also be dry. The existing granulated materials feed easily, but the particles tend to be too small. Lumps of broken-up cast ferro-alloy would seem to be able to meet the size requirement, but there is then an unavoidable loss in the form of fines. Some users would also seem to have a preference for the form of granules over that of broken-up material. There appears to be no prior art which can produce, without significant disadvantages, a granular material with the form and size preferred by the users.

There is therefore, notwithstanding the efforts of others, still a specific need for a reliable, safe, convenient and cheap process to convert molten metal by direct solidification, without intervening crushing, into solid pieces as lumps of a size and form that are acceptable to the end users. These lumps should preferably be substantially globular or biscuit shaped, where the longest dimension is typically between 20 and 100 mm. Besides the requirements mentioned, these lumps should ideally be capable of withstanding the rigours of storage, transport and handling without degrading to fines. The technique to produce these lumps should not be more hazardous nor require more human labour and maintenance than the presently-used methods. It is obviously a requirement of such a process that it should not introduce excessive quantities of undesirable impurities into the ferro-alloy. The process should also be simple to construct and operate, particularly relative to existing methods.

SUMMARY OF THE INVENTION

The invention provides, in the first instance, a method of producing lumps or pebbles wherein a stream of molten metal is introduced in a co-current configuration into a stable flow of cooling fluid. (In other words the metal stream is introduced in a direction which is substantially the same as the direction of the cooling fluid stream). The mixture is possibly but not necessarily contained in a flume, with a small and controlled velocity mismatch between metal and coolant. This velocity mismatch should be less than 5 m/s and preferably less than 2 m/s in order that large lumps of the solid material are produced. The metal and fluid streams may be arranged to be lamellar and stable.

The words "lumps" and "pebbles" are used interchangeably herein.

The fluid may be:

water;

an organic or inorganic liquid;

a slurry (for example a suspension of dense medium, graphite or other fine substances);

an emulsion or a solution, containing salts (e.g. brine), surface active agents or liquids (organic or inorganic);

a fluidised bed of fine, solid particles.

The important properties of the cooling fluid include its density, boiling point, heat capacity, heat transfer ability, viscosity and its chemical reactivity with the surface of the hot lumps. Although water is generally preferred on account of its availability, cleanliness and heat capacity, other liquids or mixtures of substances may offer benefits. For example, the addition of a soluble salt to water will increase its boiling point and accelerate its ability to transfer heat out of the hot metal or slag. The density and viscosity of water can also be altered by preparing a water-based slurry, for example of ferro-silicon, magnetite or graphite powders in water. Densities of as high as 3.5 g/cm$^3$ can be achieved by the addition of ferro-silicon powder. The addition of graphite will improve the lubrication between solid lumps and floor of the flume and will also change the oxygen potential of the coolant. A similar change to the oxygen potential of the coolant can be achieved by the addition of higher alcohols such as isopropyl alcohol. The system can be rendered moderately oxidising, if desired, by the addition of a nitrate salt. Conversely, reducing conditions can be assured by adding a nitrite salt. In the case of special, high value metals, there could be an advantage to using an organic liquid, such as oil, or a silicone-based liquid, as the coolant. The addition of surfactants, oxidants or reductants, or other trace chemicals which can modify the surface chemical reactions between the hot lumps and coolant is also advantageous. A fluidised bed offers the prospect of extremely high densities.

The fluid may be unsupported and may be permitted to fall freely. In this case, the process involves a gentle co-current introduction of metal into the fluid stream and is different from the Showa Denko granulation process where an essentially vertical stream of metal is shattered by a fast-flowing horizontal stream of liquid.

Alternatively the fluid stream may be guided for movement along a predetermined path by means of a suitable structure, such as a flume. When use is made of a structure to guide the flow of the fluid stream then the inclination, length and shape of the structure can be arranged or varied according to requirement so that the molten metal stream slides down the structure while submerged in the fluid stream, while simultaneously ensuring that adequate cooling and control of the shape of the lumps are achieved.

The shape of the product may be controlled to some extent by the shape of the channels in the flume. The floor of the flume may have a large number of parallel channels, effectively creating parallel paths down which a number of streams of hot metal are swept simultaneously.

An on-line assessment of the shape of the lumps may be used to control the position of a tundish, from which the molten metal is supplied, in a feedback system.

The flume may have a complex shape. As one example, this may include an initial region of a relatively steep inclination and a secondary region of a relatively shallow inclination, which may be substantially linear. The curvature in this initial region may be such that the trajectories of the cooling fluid and the metal stream are matched so that the effective vertical acceleration of the metal stream is reduced below that normally due to gravity. Under these conditions, the fluid and the metal streams may be made to accelerate downwards at close to or even beyond free fall conditions. The flume may alternatively have a straight path inclined at whatever slope is considered convenient. Another possibility is to have undulations along a region of the flume. As a further option, when viewed in plan, the flume may be straight or it may follow a curved path, for example a spiral flume. The optimum profile may depend on the nature of the material to be processed, and a different profile may be needed for each type of material.

The aspect ratio, shape and size of the resulting pebbles may be influenced by one or more of the following: the inclination of the supporting structure for the fluid stream; the cross-sectional profile of the supporting structure for the fluid stream, the amount by which the temperature of the metal stream exceeds the liquidus temperature, also known as the "superheat"; the angle of impingement of the metal stream onto the cooling fluid or onto a floor of the supporting structure used for guiding the fluid stream; the temperature and composition of the cooling fluid stream; and the rate of flow of the cooling fluid or of the metal stream, or both, and the inherent turbulent flow patterns within the cooling fluid and metal.

An important aspect of the invention is that the lumps, after they have formed in the cooling fluid, should be allowed to solidify sufficiently with a thick enough skin before any impact is experienced to avoid a distortion of their shapes. The time needed for sufficient solidification is a function of a number of parameters. These include the rate of heat transfer from the lumps, the amount of energy that needs to be removed, the time in contact with the cooling fluid, the type of cooling fluid, the size and shape of the lumps, the mechanical and thermal properties of the lumps at elevated temperatures, and the surface tension of the liquid lumps. It is important that the metal stream should be submerged in the fluid stream for long enough to ensure that sufficient heat is extracted from the metal so that the metal is rigid when it is separated from the fluid stream.

Separation of the metal from the fluid stream may be effected by ejecting the metal lumps from the cooling fluid into a holding or collecting tank or on to a fluid/metal separator such as a chain grate or a vibrating deck. The apparatus should be such that a pile-up of the rigid but hot lumps of material cannot occur. This is required in order to prevent steam or hydrogen explosions.

The pieces of metal may be removed either by an apparatus similar to a continuous grate conveyer or by a vibratory conveyor or other apparatus. If a soluble material forms part of the fluid, then a spray and wash station may be used at this stage.

The material may be cooled further after separation and transported to a convenient storage place or a standard arrangement to screen and sort the lumps. A means of cooling the lumps while moving them may also be provided. For example the lumps may be collected or otherwise positioned on a heat resistant conveyor such as a grate conveyor, and they may be dried by means of air which is directed on to the lumps.

The invention also provides for the apparatus to produce a stream of a coolant fluid and for introducing a stream of molten metal into the coolant stream in a substantially co-current manner.

Means may be provided for varying the flow rates of the coolant and the metal. For example, use may be made of a variable speed pump, or control valves, to vary the velocity and flow rate of the coolant.

The ratio of the flow rate of the molten metal to the flow rate of the coolant may be between 1:5 and 1:15, and typically is of the order of 1:10, on a mass basis.

The rate of flow of the metal may also be controlled in any appropriate manner and for example may be controlled by varying the head of metal in a tundish which is positioned to discharge into the fluid stream. The cross section of an exit aperture of the tundish may be varied to alter the velocity and flow rate of the metal stream, for example by changing the diameter dynamically during the pour or prior to the pour or by using a conical plug. The position of the tundish may be adjustable so that it can be moved in a horizontal or in a vertical plane in order that the metal stream may fall into the coolant at an optimum angle and at an optimum position. Tilting mechanisms for the pouring of the metal from the ladle to the tundish and for controlling the flow rate of the metal may also be included in the apparatus. Emergency overflows for excess metal may also form a part of the control of the metal flow rate.

The apparatus may include a spout or spouts of appropriate geometry to lead the metal from the tundish into the coolant at the appropriate velocity and inclination.

The coolant will be unavoidably turbulent because of the high Reynolds number, but it should be smooth and stable. Excessive turbulence is to be avoided as this may affect the shape and size of the lumps. To achieve this characteristic, the apparatus may include a stilling well into which the coolant is fed, and a weir that the coolant spills over to pass from the stilling well into the flume. An initial region of the flume before the metal is added may be used to allow any excessive turbulence to dissipate. A header tank may also be provided so that in the event of a power cut, the coolant would continue for a further given time period. Because heat is dissipated in the fluid, equipment to cool the fluid may be required.

BRIEF DESCRIPTION OF THE DRAWINGS

The invention is further described by way of examples with reference to the accompanying drawings in which:

FIG. 1 illustrates some possible different cross-sectional profiles of a flume for use in the apparatus of the invention;

FIG. 2 depicts a calculated temperature profile within a spherical lump of molten ferrochromium that has been quenched in water at 15° C.;

THEORETICAL ANALYSIS

Figure 3:
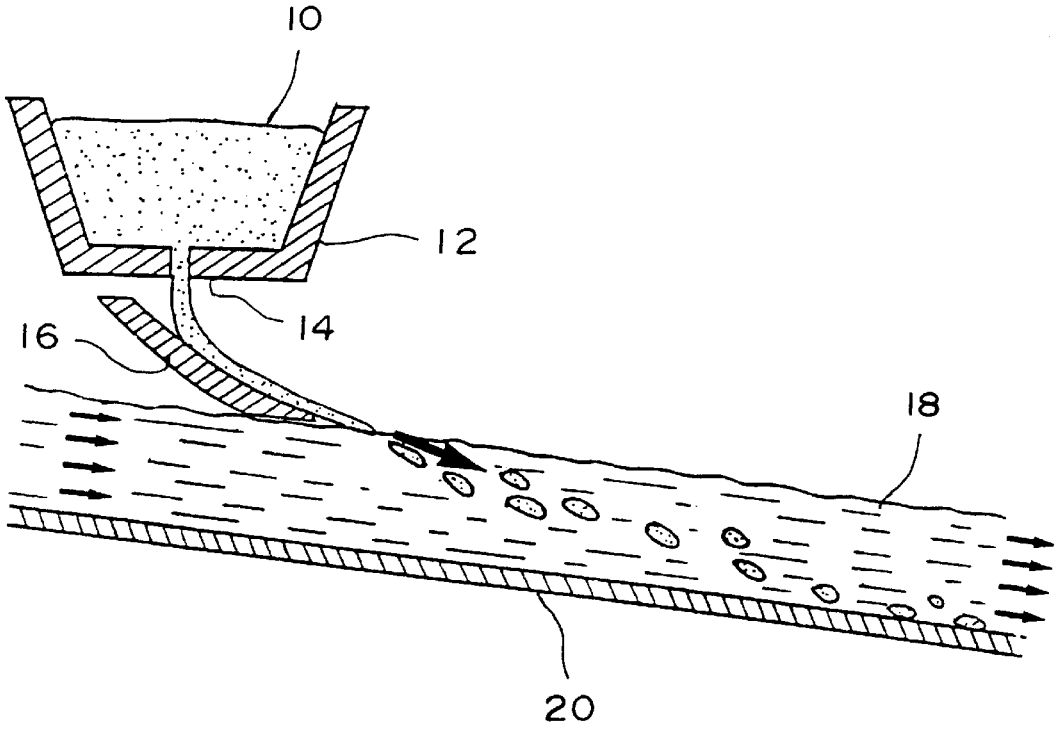
FIG. 3 is a schematic side view of the apparatus of the invention, illustrating the principles of co-current injection and minimum velocity mismatch.

The present invention was suggested by the results of a theoretical analysis of the processes acting on a blob of molten metal or slag coming into contact with a coolant liquid such as water. Therefore, the reasoning employed to arrive at the claimed invention will be briefly described.

The sizes of the lumps resulting from the granulation process depend on the way the liquid metal is handled while it is being cooled to solidification. There are a number of forces that influence the shape of a lump during such a process, and the eventual sizes and shapes are determined by the ways in which, and the extents to which, these forces are brought to bear on the lumps. The forces of relevance are:

Surface tension. The surface-tension force tries to pull the lump into a ball, but is relatively weak. This is the main force that has to be relied upon to hold a large lump together while it is still liquid.

Hydrodynamic drag forces. Any object moving through a fluid will experience drag forces. In the case of a blob of liquid metal flowing through a coolant, the drag forces will tend to rip the surface away, and so break up the blob.

Forces of motion. Flows of either the liquid metal or the coolant will try to keep moving because of their momentum. A stream of liquid impacting on a surface will flatten and spread out, and may then break up into blobs or droplets. Even the presence of strong flows inside a blob of liquid are capable of breaking up the blob.

Gravity and containment forces. Gravity is relatively strong compared to the other forces acting on a blob, and in particular over a relatively short distance it can accelerate a blob to speeds at which the other forces that are then incurred cause the blob to break up. Gravity also causes a liquid that is held in a vessel to take the shape of the vessel. However, if the liquid does not wet the material of the floor of the vessel, it will tend to be pulled into a ball by the surface tension forces while simultaneously being flattened by gravity.

Friction forces. A lump of metal sliding down a channel will experience a friction drag from its rubbing against the floor of the channel. If the lump is only partly solidified, this friction force may be enough to distort the shape of the lump or even to tear the lump apart.

The invention is based on the use of apparatus which is designed to produce these forces in a combination which acts to form large lumps of metal or slag, instead of the relatively smaller lumps which are formed in other granulators. The large lumps of metal must be formed under conditions which are relatively safer than, for example, simply pouring a stream of hot metal into water. To achieve these objectives it has been established that the stream of hot liquid metal must not be subjected to drag forces or forces of motion that exceed the surface tension forces. Secondly the stream must be split into blobs of the required size and shape. Lastly the blobs must not be subsequently subjected to excessive forces of any type until they have solidified sufficiently.

Modelling and simulation of the formation of individual blobs by finite-element methods is almost impossible because the process is essentially random. However, quantitative studies of the basic mechanisms can yield some insight, and there are also other approaches that can be used, such as dimensional analysis and free energy. The following analysis makes use of these concepts. It will be shown that the breakup of a metal stream into the desired sequence of blobs can be achieved by addressing especially the interplay between surface tension and drag, the amount of material charged to the flume at any particular instant, and the kinetic energy imparted to the metal or slag stream. The observations described hereinafter were verified with the assistance of water modelling.

Ratio of drag to surface tension forces.

Consider a spherical blob moving through a fluid. The drag force is given by:

$$F_{drag}=C_D.(r\sigma^2).(\rho v^2/2) \tag{1}$$

while the surface-tension force that holds any two halves of the blob together is given by:

$$F_{surften}=\sigma.2\pi r \tag{2}$$

where:

$C_D$ is the drag coefficient (dimensionless)

r is the radius of the blob (meters)

ρ is the density of the fluid surrounding the blob (kilograms per cubic meter)

ν is the velocity of the blob relative to the fluid (meters per second), and

σ is the surface tension of the blob's interface with the fluid (newtons per meter).

The ratio of these two forces is therefore:

$$\text{Ratio} = F_{drag} / F_{surften} = \left(\frac{C_D}{4}\right)\left(\frac{\rho v^2 r}{\sigma}\right) \tag{3}$$

The first bracket in equation 3 is essentially constant for a given geometry. Therefore, the more important term in terms of the practical problem at hand is the second bracket, which may be defined here as the blob number, $N_{blob}$:

$$N_{blob} = \frac{\rho v^2 r}{\sigma} \tag{4}$$

This dimensionless number is also called the Weber number, but as there are other definitions of the Weber number, the specific name "blob number" has been used to avoid confusion.

A blob will be torn apart when $N_{blob}$ exceeds a certain critical value. Conversely, the blob will stay intact if the blob number remains below the critical value. In equation 4, the parameters σ and ρ depend only on the substance of the blobs, so for a given desired size of the blobs, i.e. given r, only ν can be varied to keep the blob number below the critical value. Furthermore, if the velocity ν goes up then the size r will go down. In practical terms, this means that the velocity of the blobs must be kept relatively similar to the velocity of the fluid if large lumps are to be obtained.

The departure from the prior art is to achieve this by bringing together the streams of hot metal and water co-currently and at similar velocities.

Splitting up of the Stream of Hot Metal

A ribbon of liquid metal in a channel is characterized by a free energy, which is a combination of the surface energy and the potential energy. However, in some cases, such a ribbon can achieve a lower free energy by spontaneously breaking up into blobs. It can be shown theoretically that there is a minimum free energy for such a stream at a certain mass per unit of length (kilograms per meter), which is referred to herein as the critical loading. At this critical loading, a ribbon of liquid metal will stay as a continuous ribbon and will not break up into blobs, because the free energy is at its minimum and cannot go any lower. If the ribbon starts off with less mass per unit length than the critical loading, the extra free energy will spontaneously drive the system to break up the ribbon into segments so that within each segment the mass per unit of length becomes approximately equal to the critical loading. Conversely, if there is more mass per length than the critical loading, the excess mass will attempt to flow out of the ends of the ribbon, to get back to the critical loading.

In practical terms, this means that the apparatus must be run with a flow of hot metal that produces a loading just below the critical value, so that the ribbon will break up. For iron, steel, ferrous alloys, and other materials that have similar surface tensions and densities, it can be calculated that for typical flume designs this critical loading is of the order of about 1.5 kilograms per meter, although this value does depend on parameters that can vary, such as surface tension, density, and curvature of the channel. If, for example, the velocity of the metal is of the order of 2.0 meters per second, then the absolute maximum throughput is approximately 1.5 kilograms per meter×2.0 meters per second=3.0 kilograms per second.

Forces of Motion

Because the surface-tension force is relatively weak, the surface energy is relatively small by comparison with the typical kinetic energies and potential energies. Hence, if a largish blob of liquid metal is dropped more than just a small amount onto a surface, it will tend to splatter and so break up into smaller drops.

Some typical comparative values are as follows. Consider a blob of mass 0.1 kilograms, with a surface area of 0.003 square meters. If the surface tension is 1.0 newtons per meter, then the surface energy per unit of mass is 0.03 joules per kilogram (– calculated from 0.003 square meters×1.0 newtons per meter÷0.1 kilograms). For the kinetic energy of the blob to match this needs a velocity of only about 0.25 meters per second (– calculated from √(2×0.03 joules per kilogram)). Alternatively, equating this to potential energy requires an elevation of only 3 millimeters (– calculated from 0.03 joules per kilogram÷9.8 meters per second squared). Not all of a blob's potential or kinetic energy will go into overcoming the surface energy, but it should be evident from these values why it is necessary to introduce the hot liquid metal into the stream of water very gently, specifically being careful to make the flows co-current and of a similar velocity, and not to drop the stream of hot metal too far before it meets the water.

Calculation of the Transient Thermal Field

The previous section has explained why it is important that a blob is not subjected to impact or other external forces until it has solidified. In this section the length of time that the blob must remain in the coolant stream before it is solid is addressed. This parameter controls the length of the flume. Since such information is difficult to measure with accuracy, these temperature distributions were calculated.

The published explicit solutions to transient heat flow through spheres and slabs were harnessed, together with the available thermophysical data, and together used as input into a custom-designed computer program. An assessment of the dimensionless number known as the Biot number, $N_{Bi}$, revealed that the temperature gradients inside a volume of liquid ferro-alloy are less steep than those between lump and environment, and thereby indicated that an explicit series solution was required in order to calculate the temperatures. The most relevant part of the heat transfer calculation for the case of granulation applies to the first few seconds, and therefore up to 80 terms were required in the series calculations in order to provide reasonable accuracy.

The various physical parameters necessary to undertake these calculations are listed in Table 1. The values were obtained from the literature where available and cross-checked by means of crude calorimetric and heat transfer experiments.

TABLE 1

Data used to model the temperature distribution within spheres and slabs of ferrochromium.

| Property | Values |
|---|---|
| Temperature of melt, ° C. | 1600 |

TABLE 1-continued

Data used to model the temperature distribution within spheres and slabs of ferrochromium.

| Property | Values |
|---|---|
| Liquidus temperature, ° C. | 1560 |
| Temperature at which stiff, ° C. | 1500 |
| Temperature of fluid, ° C. | 15 |
| Emissivity | 0.2to0.4 |
| Thermal conductivity, W/m/k | 20 (porous) to 50 (solid) |
| Effective heat capacity*, J/kg/K | 838 |
| Density at 1500° C., kg/m$^3$ | 6600 |
| hc in air, W/m$^2$/K | 5 (still air) to 80 (forced air) |
| hc in water (film boiling), W/m$^2$/K | 300 to 600 |
| Radiant h, W/m$^2$/K | 90 to 200 |
| Combined h, W/m$^2$/K | 650 to 850 |

*includes latent heat of solidification

The heat transfer from a blob of molten ferro-alloy will initially be by a combination of convection and radiation. However, the explicit analytical expressions referred to only consider convective heat transfer across a boundary layer. Nevertheless, since radiant heat transfer is also important in the case of very hot metals or slags it was accounted for in the form of an equivalent heat transfer coefficient, $h_r$ where $$h_r=\sigma.\epsilon.(T_s+T_a).(T_s^2+T_2^a)$$

where σ is the Stefan-Boltzmann constant and ϵ is the emissivity of the metal.

The total amount of heat transferred to the environment is therefore approximately $$q=A.(h_r+h_c).(T_s-T_a)$$

The heat transfer calculations were combined with a knowledge of the temperature at which the metal becomes sufficiently solid to resist impact deformation (determined as described in the section to follow), to yield an estimate of the minimum time necessary to stabilize the desired shape, and hence the required length of the flume.

Determination of the Temperature at Which Rigidity is Established

It may be assumed that metals will not be able to withstand a shear stress when above their liquidus temperatures, and that they will be solid below their solidus temperatures. Clearly, therefore, the critical temperature at which a solidifying blob of metal becomes rigid will lie somewhere between the liquidus and solidus temperatures.

Since the precise values of the liquidus and solidus temperatures have an influence on the pebble casting process, the relevant temperatures for the materials used in the experimental trials were determined from the phase diagrams and confirmed in some cases by differential thermal analysis (DTA).

The temperature at which rigidity is established depends on how an alloy solidifies and reference should be made to FIG. 2. In the case of charge chrome, a significant proportion of refractory $Cr_7C_3$ needles is formed quite rapidly, and in considerable quantities, in the temperature range from liquidus to about 50° C. below the liquidus. These needles were observed in later metallographic examinations to interlock. Although the last of the liquid only solidifies at around 1200° C., it was found that a bulk sample of charge chrome was already rigid at about 1500° C. Similar behaviour, but over other ranges of temperature, are expected for other metals.

Determination of the Critical Time to Reach Rigidity for Different Sized Blobs

The time for a blob of liquid material to become rigid depends on a number of factors, including the rate of heat transfer, the size and shape of the blob, and the temperature and composition of the medium in which it solidifies. A number of different cooling fluids could be used, as has been mentioned earlier. To demonstrate this, in the calculations that follow, it has been assumed that rigidity in a sphere of high carbon ferrochromium is achieved when a skin of material at 1500° C. or less has extended approximately 20% of the distance towards the centre of the sphere. Similar calculations are possible for other metals.

Calculations for a 10 mm diameter blob show that it will take an impracticably long time to solidify in air. However, when water is the quenching medium the blob is effectively rigid in less than one second. In the present work, it is desired to produce pebbles with a characteristic dimension of about 20 to 100 mm. This leads to the requirement that heat must be extracted by a medium such as water for 2½ to 3½ seconds before the blob will be rigid.

Practical Implementation

Various configurations of the apparatus were tested. A flume of 2 m length was found to be too short, resulting in still-liquid blobs being ejected. A 10 m flume produced solid material. For the channel, three radii of curvature were tried, namely 50 mm, 75 mm and 100 mm. All three worked, but the smallest radius of curvature tended to produce blobs that were rather narrow. The largest radius of curvature, on the other hand, was too flat as the stream of metal tended to meander from side to side and collide with the side walls of the channel.

Figure 6:
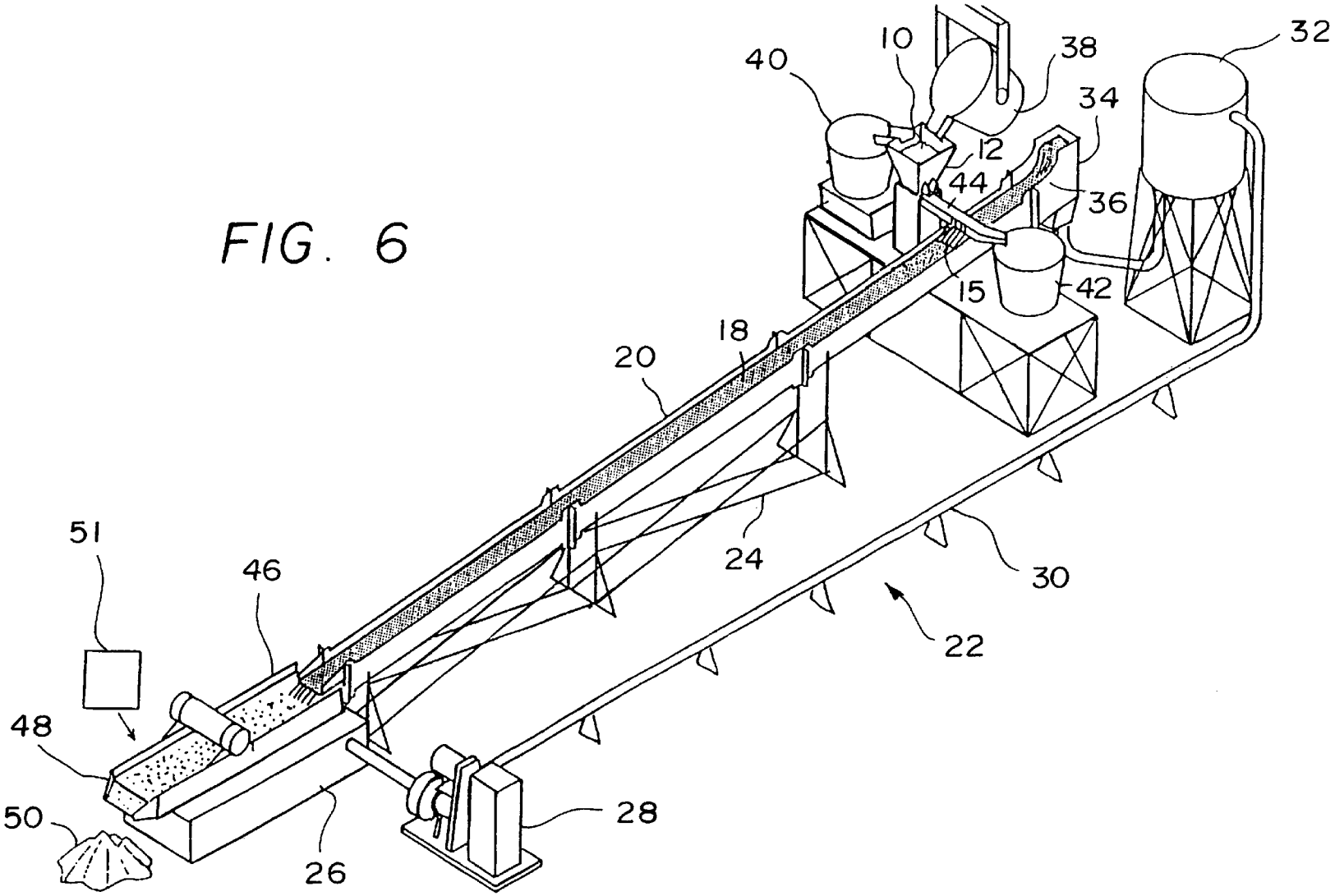
FIG. 6 illustrates an example of apparatus according to the invention for the production of pebbles on a commercial scale.

Fluid flow in a channel is well analyzed in the literature. The velocity of the water flowing down the flume depends on the flow rate, the slope and the hydraulic radius. In the apparatus of the invention, as shown in FIGS. 3 and 6, the water velocity was about 2 to 3 meters per second with a slope of from about 1 in 7 to 1 in 13 and a flow rate of about 10 to 25 liters per second per channel. Steep slopes created excessive turbulence which adversely affected the shapes of the blobs. Shallower slopes and lower flow rates occasionally caused a blob to get stuck in the flume. In all cases, a settling distance of about 2 meters was provided to allow the initial rough liquid flow to settle down, before the metal was added.

FIG. 3 illustrates in enlarged detail a portion of the apparatus shown in FIG. 6. Molten metal 10 is contained in a tundish 12 and is discharged through one or more holes 14 onto a short refractory lined channel or spout 16. The metal discharge rate is regulated by the size of the hole in the tundish.

The spout 16 guides the stream of hot metal from the tundish 12 and leads it gently into the water stream 18 in a launder or flume 20.

The flow rates of metal are typically about 1.5 to 2.5 kilograms per second per flume channel. High flow rates tend to encourage strings of "sausages" rather than discrete blobs, although the exact limit depends on the type of metal. It has experimentally been determined that a loading of 1.8 kilograms of mild steel per meter of channel length produces a continuous "sausage". There is no particular disadvantage with a lower metal flow rate except for the likelihood of the metal freezing up at very low flow rates and the fact that a lower flow rate implies a lower throughput which affects the economic viability of the process.

FIG. 6 is a schematic perspective illustration of apparatus 22 according to the invention. Like reference numerals to those employed in FIG. 3 are used to indicate like components.

The flume 20 may be a single or multi-channel device and is supported on a suitable structure 24 to give the required flume inclination. The flume discharges into a catching tank 26 and water is circulated from this tank by means of a pump 28, through a pipeline 30 to a header tank 32. The header tank discharges into a stilling well 34 at the upper end of the flume and overflow from the well is directed into an upper portion 36 of the flume which allows the liquid flow to stabilise.

The tundish is charged with molten metal from a ladle 38 which is supported by means of a suitable crane, not shown. Standby ladles 40 and 42 are safety receiving vessels that can take any molten metal overflows that might occur. Molten metal from the tundish flows into a cross channel 44 which discharges into the spout 16, if there is a single channel in the flume, or into a number of spouts if there are multiple channels in the flume.

The flow rates of the cooling water stream and of the molten metal stream may be controlled to ensure an optimal production of metal lumps. The cooling water flow rate can be controlled by varying the speed of the pump 28, or by using control valves (not shown), to vary the velocity and flow rate of the water.

The rate of flow of the molten metal may be controlled for example by varying the head of metal in the tundish or the cross-section of the exit aperture of the tundish through which the molten metal is discharged. The position of the tundish and cross channel assembly may also be adjusted. For example the assembly can be moved horizontally or vertically, to ensure that the metal stream falls into the water stream at an optimum angle and at an optimum position.

A vibratory separator 46 is mounted above the catching tank. The separator traps the lumps of solid metal and allows the liquid to flow through to the tank. The separator advances the metal lumps towards its discharge end 48 and the lumps falling from the separator are collected in a heap 50, or may be fed to a cooler and dryer.

Known granulating processes produce wet or damp granules. The introduction of such granules into a furnace can produce explosive results. It is therefore desirable to ensure that the lumps are dried and this may be achieved, for example, by using a separator such as a chain grate, or any other suitable heat resistant conveyor, to separate the liquid from the metal lumps. As shown in FIG. 6 the separator 46, which may be of a considerable length, is then used to transport the lumps past one or more air blowers 51 which direct streams of air onto the lumps, from different directions if necessary, to ensure that the lumps are at least partly dried and, at least to some extent, are cooled.

As an alternative to the vibratory separator a chain grate may be used to separate the liquid from the metal lumps.

Safety is an important consideration in the operation of the apparatus. As with conventional granulators the contacting of molten metal with water occasionally produces explosions. In the apparatus of the invention however the amount of metal in contact with the water at any given time is relatively small.

FIG. 1 illustrates some possible different cross-sectional profiles of the flume.

FIG. 1(*a*) illustrates a flume with a relatively small radius of curvature while FIG. 1(*b*) illustrates a relatively large radius of curvature. FIG. 1(*c*) illustrates the concept of a water jacket 52 conforming to the inner cross-sectional shape of the flume.

FIG. 1(*d*) shows a flume with two side-by-side channels each of which accommodates a fluid stream into which a respective stream of molten metal is directed.

FIG. 1(*e*) shows a flume with a central channel 54 in which a molten metal stream is concentrated and which is flanked by outer channels 56 which allow for a relatively greater volume of water flow. The last mentioned design tends to limit the meandering effect of the liquid metal, referred to earlier, when the channel radius is too large.

Trials with Molten Metals

Equipment

An induction furnace was used to remelt up to 50 kg of metal which was tapped and transferred to a tundish, from where it flowed into the flume. The tapping temperatures of the metal were recorded with a dip thermocouple or a pyrometer or both.

Procedure

Several runs were carried out on this apparatus using a number of alloys with a variety of different set-up configurations. The nominal compositions of some of the alloys used are given in Table 2 below.

TABLE 2

Compositions of the ferro-alloys used for the pebble casting trials

| Material | Fe | Cr | Mn | Si | C | Melting range, ° C. |
|---|---|---|---|---|---|---|
| charge chrome | 38 | 52 | — | 3 | 7 | 1200–1570 |
| 0.5% carbon ferrochromium | 44 | 54 | — | 1.4 | 0.5 | 1500–1600 |
| medium carbon ferro-manganese | 17 | — | 80 | 1 | 2 | 1180–1220 |
| ferro-silicon | 25 | — | — | 71 | 0.4 | 1215–1370 |

Results

As predicted by the theoretical analysis, it was found that too great a degree of coolant turbulence produced irregular shaped particles, and too low an inclination of the flume or too great a metal flow caused the formation of long sausages. The best-shaped product was obtained with a flume length of 10 m, an inclination in the range 1 in 8 to 1 in 12, a metal feeding rate of about 1.5 kg per second per channel, and a relatively smooth stream of water, flowing at about 15 liters per second per channel. Thus the ratio of the metal to water flow rates is of the order of 1:10, on a mass basis.

Figure 4:
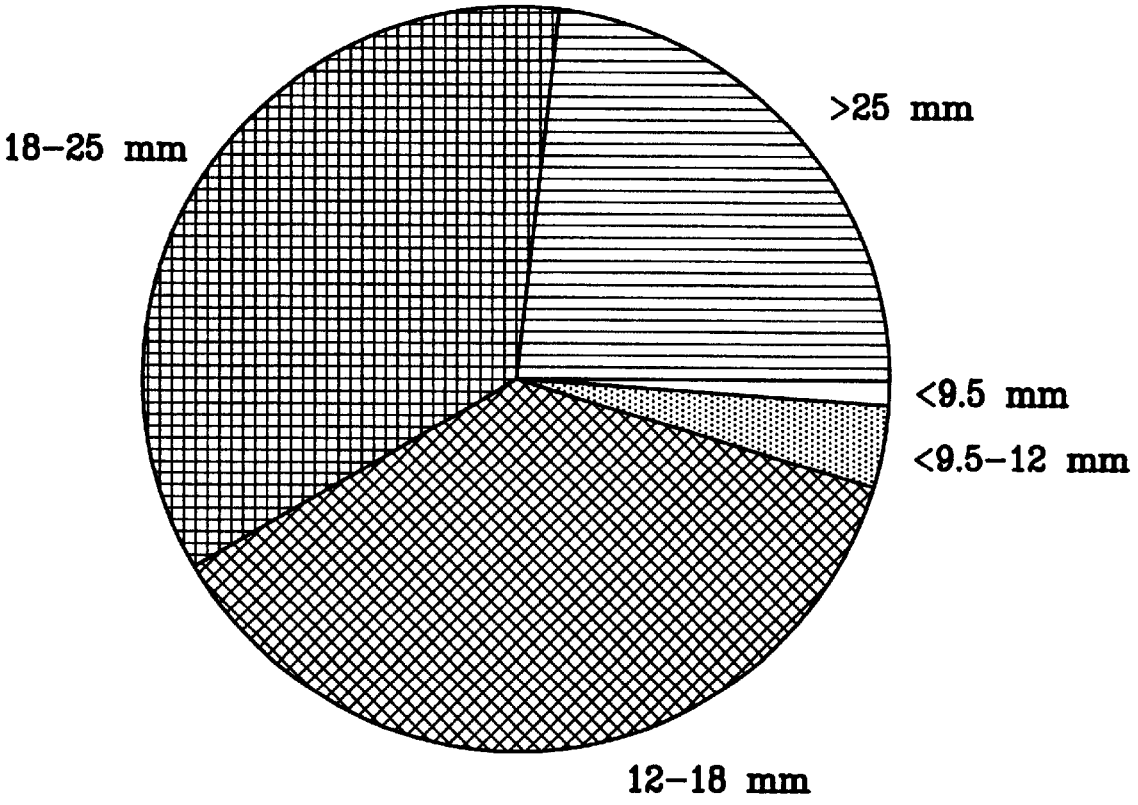
FIG. 4 depicts a pie chart which shows the relative proportions of pebble sizes produced using the invention.
Figure 5A:
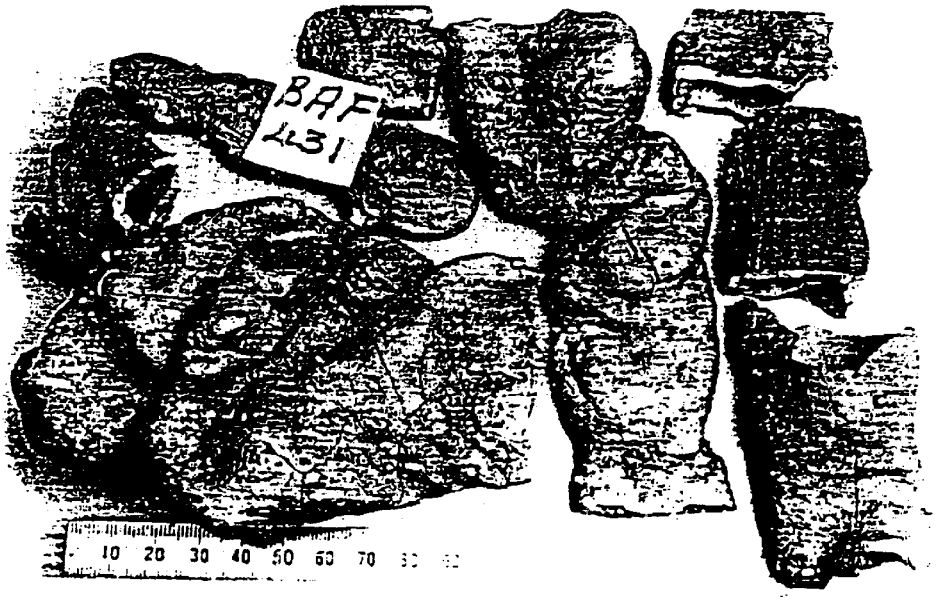
FIG. 5 contains photographs of pebbles produced in laboratory-scale apparatus using the principles of the invention.
Figure 5B:
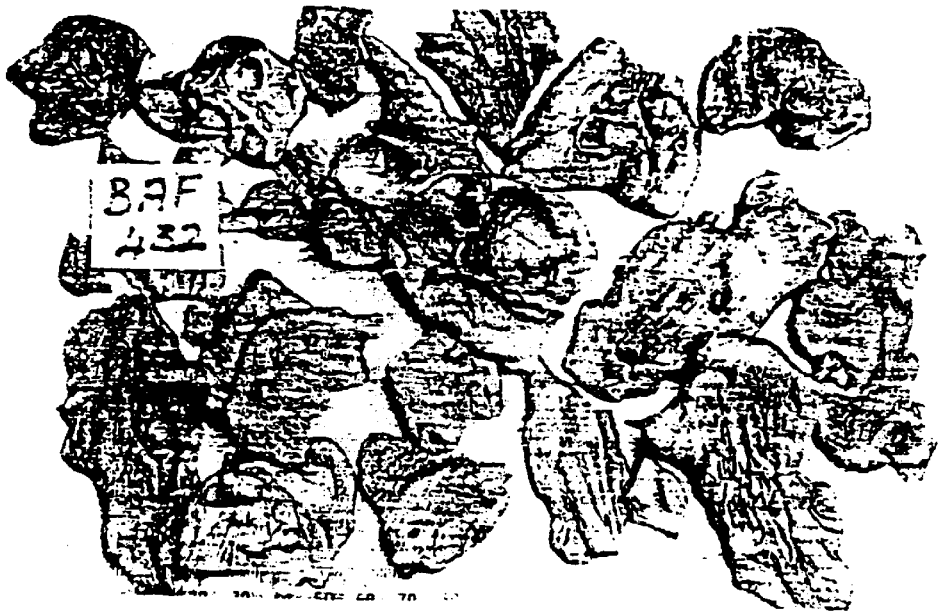
Figure 5C:
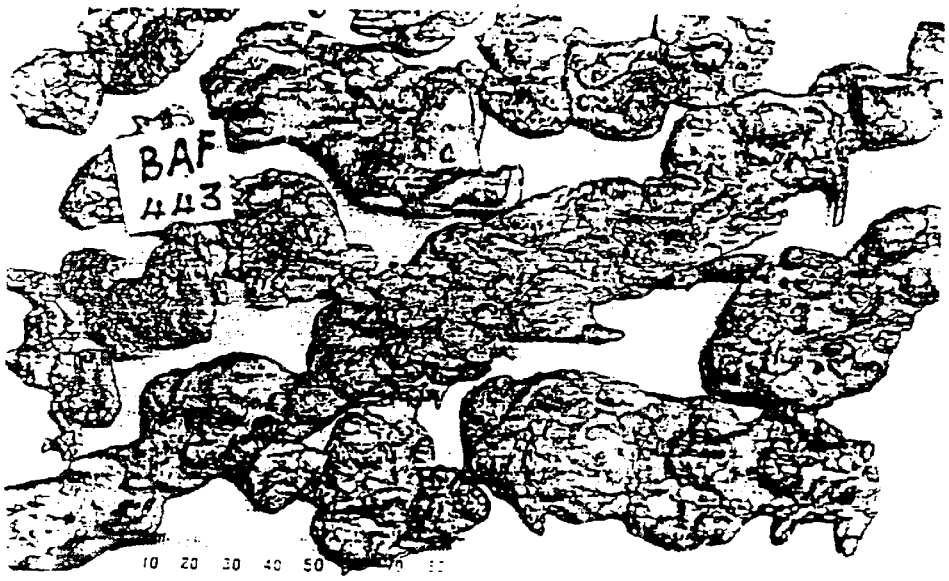
Figure 5D:
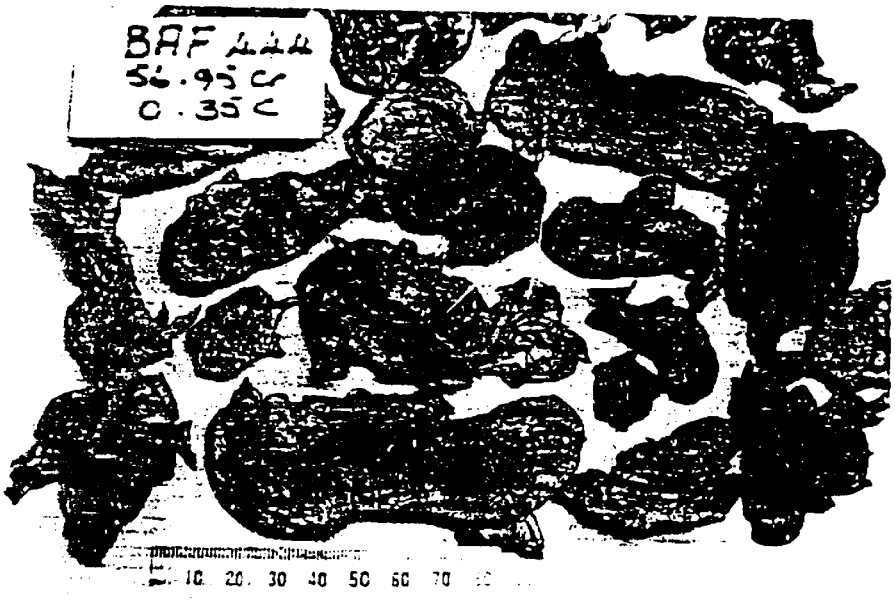

Some of the products obtained using different configurations and metals are shown in FIGS. 5, 5(*a*), (*b*), (*c*) and (*d*), while FIG. 4 shows the size distribution of lumps which were produced.

The experiments were conducted on a plant capable of processing only 0.15 tons of liquid metal per minute. A full-scale plant would be required to process molten metal at a rate of at up to about 3 tons per minute, and would have to run without interruption for up to 30 minutes.

What is claimed is:

1. A method of producing lumps of metal wherein a stream of molten metal is introduced at a first velocity, in a co-current configuration, into a stable flow, at a second velocity, of a cooling fluid, the difference between the first velocity and the second velocity being less than 5 meters per second, and the metal being at least substantially submerged in the cooling fluid.

2. A method according to claim 1, wherein the cooling fluid is selected from one of: water; an organic and an inorganic liquid; a slurry; an emulsion or a solution, containing salts, surface active agents or liquids; and a fluidised bed of fine, solid particles.

3. A method according to claim 1, wherein the velocity difference is less than 2 meters per second.

4. A method according to claim 1, wherein the cooling fluid is unsupported.

5. A method according to claim 1, wherein the cooling fluid is guided for movement along a predetermined path by means of a suitable structure.

6. A method according to claim 5, wherein the predetermined path is inclined to the vertical.

7. A method according to claim 5, which includes the step of varying the inclination, length or shape of the structure to maintain the molten metal stream submerged in the cooling fluid.

8. A method according to claim 5, wherein the predetermined path includes at least a first region with a first inclination and a second region with a second inclination which differs from the first inclination.

9. A method according to claim 8, wherein the curvature of the initial region is such that the trajectories of the cooling fluid and the metal stream are matched so that the effective vertical acceleration of the metal stream is reduced below that normally due to gravity.

10. A method according to claim 5, which includes the step of controlling the aspect of ratio, shape and size of the lumps by varying one or more of the following: the inclination of the supporting structure for the fluid stream; the cross-sectional profile of the supporting structure for the fluid stream; the amount by which the temperature of the metal stream exceeds the liquidus temperature; the angle of impingement of the metal stream onto the cooling fluid or onto a floor of the supporting structure; the temperature and composition of the liquid stream; the rate of flow of the cooling fluid or of the metal stream, or both; and the inherent turbulent flow patterns within the cooling fluid and metal.

11. A method according to claim 1, wherein the lumps, after they have formed in the cooling fluid, are allowed to solidify sufficiently with a thick enough skin before any impact is experienced to avoid a distortion of their shapes.

12. A method according to claim 11, wherein the lumps, after they have formed, are kept submerged in the cooling fluid at least for a period of time which is a function of the following: the rate of heat transfer from the lumps; the amount of energy that needs to be removed; the size and shape of the lumps; the mechanical and thermal properties of the lumps at elevated temperatures; and the surface tension of the liquid lumps.

13. A method according to claim 1, which includes the step of separating the lumps from the cooling fluid.

14. A method according to claim 13, wherein the lumps are separated by ejecting the metal lumps from the cooling fluid into a holding or collecting tank or onto a fluid/metal separator.

15. A method according to claim 13, which includes the step of drying the metal lumps.

16. A method of producing metal lumps wherein a stream of molten metal is introduced into a stream of cooling liquid in such a way that:

(a) the direction of the stream of molten metal is inclined to the vertical and is substantially the same as the direction of the cooling liquid stream;

(b) the difference between the velocity of the stream of molten metal and the velocity of the cooling liquid stream is less than 5 meters per second; and (c) the molten metal is at least substantially submerged in the cooling liquid.

17. Apparatus for producing metal lumps which includes means for providing a coolant stream at a first velocity and in a first direction which is inclined to the vertical, and means for introducing a molten metal stream into the coolant stream, substantially in the first direction, and at a second velocity which differs from the first velocity by less than 5 meters per second.

18. Apparatus according to claim 17, which includes means for controlling the flow rates of the streams of the coolant and the molten metal.

19. Apparatus according to claim 18, wherein the molten metal stream is supplied by a tundish and the flow rate thereof is controlled by varying at least one of the following: the head of metal in the tundish; the cross-section of an exit aperture from the tundish; the position of the tundish.

20. Apparatus according to claim 17, which includes at leat one refractory spout for introducing the molten metal stream into the coolant stream at the second velocity and substantially in the first direction.

21. Apparatus according to claim 17, which includes a flume in which the coolant stream flows.

22. Apparatus according to claim 21, which includes a stilling well into which the coolant is fed, and a weir that the coolant spills over the pass from the stilling well into the flume.

23. Apparatus according to claim 21, wherein the flume has an initial region is which only the coolant stream flows, and a secondary region at the start of which the molten metal stream is introduced into the coolant stream.

24. Apparatus according to claim 21, which includes means at a lower end of the flume for separating metal lumps from the coolant stream.

25. Apparatus according to claim 21, wherein the flume has a channel radius of between 50 and 100 mm.

26. Apparatus according to claim 21, wherein the flume has a slope of from 1 in 7 to 1 in 13.

27. Apparatus according to claim 21, wherein the flow rate of the coolant stream is from 10 to 25 liters per second per flume channel.

28. Apparatus according to claim 21, wherein the flow rate of the molten metal stream is from 1.5 to 2.5 kilograms per second per flume channel.

29. Apparatus according to claim 17, wherein the ratio of the flow rate of the molten metal stream to the flow rate of the coolant stream is between 1:5 and 1:15, on a mass basis.

30. Apparatus according to claim 29, wherein the ratio is of the order of 1:10.

31. Apparatus according to claim 17, which includes means for separating metal lumps from the coolant.

32. Apparatus according to claim 31, which includes means for at least partly drying the metal lumps.

33. Apparatus according to claim 31, which includes means for at least partly cooling the metal lumps.

34. Apparatus for producing metal lumps which includes an inclined flume, means for feeding a coolant fluid into the flume at an upper end thereof; means for introducing a molten metal stream into the coolant fluid in the flume, in a direction which is substantially the same as the direction in which the coolant fluid flows, the difference between the velocity of the molten metal stream and the velocity of the coolant fluid being less than 5 meters per second, and means at a lower end of the flume for separating metal lumps from the coolant fluid.

* * * * *